US007289869B2

(12) United States Patent
Morita

(10) Patent No.: US 7,289,869 B2
(45) Date of Patent: Oct. 30, 2007

(54) KNITTING METHOD AND SYSTEM USING STRETCH YARN

(75) Inventor: Toshiaki Morita, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 78 days.

(21) Appl. No.: 10/553,755

(22) PCT Filed: Mar. 30, 2004

(86) PCT No.: PCT/JP2004/004487

§ 371 (c)(1),
(2), (4) Date: Oct. 18, 2005

(87) PCT Pub. No.: WO2004/094712

PCT Pub. Date: Nov. 4, 2004

(65) Prior Publication Data

US 2006/0272358 A1 Dec. 7, 2006

(30) Foreign Application Priority Data

Apr. 18, 2003 (JP) ..... 2003-114588

(51) Int. Cl.
*G06F 19/00* (2006.01)

(52) U.S. Cl. ..... 700/141; 66/125 R

(58) Field of Classification Search ..... 66/125 R, 66/126 R, 127; 700/141
See application file for complete search history.

(56) References Cited

U.S. PATENT DOCUMENTS 5,050,405 A * 9/1991 Jacobsson ..... 66/132 R
5,240,194 A * 8/1993 Noirot et al. ..... 242/418.1
5,511,394 A 4/1996 Shima
5,931,023 A * 8/1999 Brach et al. ..... 66/136
6,010,052 A 1/2000 Leins et al.
6,079,656 A 6/2000 Schmodde et al.
6,321,576 B1 * 11/2001 Barea ..... 66/132 R
6,550,285 B2 * 4/2003 Nishitani ..... 66/146
2002/0139152 A1 10/2002 Nishitani

FOREIGN PATENT DOCUMENTS

EP 0 699 792 A1 3/1996
JP 6-200453 A 7/1994
JP 7-133562 A 5/1995

(Continued)

*Primary Examiner*—Danny Worrell
(74) *Attorney, Agent, or Firm*—Harness, Dickey & Pierce, P.L.C.

(57) ABSTRACT

An object of the invention is to be capable of easily acquiring a fabric having a desired feeling using a stretch yarn. A knitting controller (20) controls a carriage (5), and the like, according to knitting data and control data stored in a memory (21). Data representing relationships between a gauge texture and a stitch loop length being obtained after knitting and the relationships between these gauge texture and stitch loop length and the length and tension of the stretch yarn (2) being fed at the time of knitting are collected previously and stored in the memory (21) in the form of table data. The knitting controller (20) sets control target values of the length and tension of the stretch yarn (2) for a yarn feed controller (23) such that a gauge texture and a stitch loop length being specified by an input unit (22) can be attained, with reference to the table data stored in the memory (21).

8 Claims, 3 Drawing Sheets

FOREIGN PATENT DOCUMENTS

| | | | |
|---|---|---|---|
| JP | 8-120548 | A | 5/1996 |
| JP | 8-325874 | A | 12/1996 |
| JP | 2676182 | B2 | 7/1997 |
| JP | 7-133562 | A | 11/1997 |
| JP | 2676182 | B2 | 11/1997 |
| JP | 9-324334 | A | 12/1997 |
| JP | 10-77538 | A | 3/1998 |
| JP | 11-500499 | A | 1/1999 |
| JP | 11-500500 | A | 1/1999 |
| JP | 3297598 | B2 | 4/2002 |
| JP | 9-324334 | A | 7/2002 |
| JP | 3297598 | B2 | 7/2002 |
| JP | 2002-227064 | A | 8/2002 |
| JP | 2003-73947 | A | 3/2003 |
| WO | WO 2004/009894 | A1 | 1/2004 |

* cited by examiner

FLAT KNITTING MACHINE 1
YARN FEEDING DEVICE 10
MAIN ROLLER 11
FOLLOWER ROLLER 12
SENSOR
18
17
BUFFER ROD 15
16
SERVOMOTOR 14
13
8
2
5
6
7
FABRIC 3
4
INPUT
22
KNITTING CONTROLLER
20
MEMORY
21
YARN FEED CONTROLLER
23

FIG. 2

30

| 31 KNITTING TEXTURE | 32 TENSION | 33 LOOP LENGTH (INITIAL LOOP LENGTH) | 34 STITCH NUMBER | 35 COURSE LENGTH AT KNITTING TIME | 36 COURSE LENGTH (mm) IN NO-LOAD STATE | 37 RATIO (AT FEEDING TIME) TO COURSE LENGTH AT 0g | 38 COURSE LENGTH (mm) IN FABRIC | 39 LOOP LENGTH (mm) IN FABRIC | 40 RATIO TO INITIAL LOOP LENGTH | 41 EQUIVALENT GAUGE |
|---|---|---|---|---|---|---|---|---|---|---|
| PLAIN KNITTING | 0g | 10 | 100 | 1000 | 1000 | 100% | 1000 | 10.0 | 100% | 7G |
| PLAIN KNITTING | 10g | 10 | 100 | 1000 | 900 | 90% | 950 | 9.5 | 95% | 8G FEELING |
| PLAIN KNITTING | 20g | 10 | 100 | 1000 | 800 | 80% | 850 | 8.5 | 85% | 10G FEELING |
| PLAIN KNITTING | 30g | 10 | 100 | 1000 | 700 | 70% | 750 | 7.5 | 75% | 12G FEELING |

KNITTING METHOD AND SYSTEM USING STRETCH YARN

TECHNICAL FIELD

The present invention relates to a knitting method and apparatus using a stretch yarn for manufacturing knitted products with a highly stretch yarn as a knitting yarn.

BACKGROUND ART

In the related art, a stretch yarn using stretch fibers such as those of rubber has been used in underwear, socks or sportswear. The stretch yarn such as a single-covered yarn has also been used in knitted products such as sweaters (refer to Japanese Unexamined Patent Publication JP-A 09-324334 (1997), for example). This single-covered stretch yarn is formed by singly winding a core yarn of highly stretchable polyurethane around a sheath yarn of other fibers. A double-covered stretch yarn which a sheath yarn us doubly wound is also fabricated (refer to Japanese Unexamined Patent Publication JP-A 10-077538 (1998), for example). Polyether-ester is also used in the core yarn to be covered (refer to Japanese Unexamined Patent Publication JP-A 08-325874 (1996), for example). The core spun yarn, which is spun to have the core yarn of the stretch fibers surrounded by other fibers, is also used as the stretch yarn (refer to JP-A 2003-073947, for example).

Knitted products are characterized by having a specific feeling on the basis of knitting loops. There has already been developed a method for producing a knitted product having a desired feeling with an ordinary knitting yarn other than a stretch yarn while controlling a loop length of the stitches (refer to Japanese Examined Patent Publication JP-B2 2676182, for example). In this knitting, the control of the stitch loop length is important so that a feeding device for the necessary stitch loop length has also been developed (refer to Japanese Unexamined Patent Publications JP-A 11-500500 (1999) and JP-A 2002-227064, for example).

The methods of JP-B2 2676182 and JP-A 2002-227064 are supposed to use the ordinary knitting yarn other than the stretch yarn. The introduction of "Detailed Description of the Invention" of JP-A 11-500500 describes that the invention relates to an electronic control feeding device containing the stretch yarn. This feeding device is provided with a stretch sensor so that the device feeds the knitting yarn to knit the stretch yarn under a predetermined tension. However, this device is deficient in the knitting of a variable texture such as knit, tuck and miss stitches. Although the tension can be set on the stretch yarn used, what feeling a fabric knitted under the set tension takes is not known before the fabric is actually knitted. For the desired fabric, therefore, the try-and-check has to be continued to take a long time period for the production.

DISCLOSURE OF THE INVENTION

An object of the invention is to provide a knitting method and apparatus using a stretch yarn using capable of easily acquiring a fabric having a desired feeling.

The invention provides a knitting method using a stretch yarn for knitting a fabric with a stretch yarn by a knitting machine capable of controlling yarn tension, comprising:

predetermining data specifying relationships between a feed length of the stretch yarn to be used for knitting fed to the knitting machine and a yarn length in a finished state of a knitted fabric obtained by shape memory properties of the stretch yarn, by changing gradually yarn tensions of the stretch yarn;

specifying the finished state of the knitted fabric; and knitting a fabric while feeding the stretch yarn to the knitting machine according to the finished state specified, the yarn tension having the relationships to the data, and the feed length of the stretch yarn.

Moreover, the invention is characterized in that the finished state is specified by the stitch loop length of the knitted fabric and the yarn tension.

Moreover, the invention is characterized by further comprising:

preparing paper pattern data expressing a shape of a knitted product to be formed of the fabric using the stretch yarn, and a feeling sample to be knitted using the stretch yarn and varying the yarn tension and the stitch loop length of the fabric being knitted;

performing the specification of the finished state of the knitted fabric based on the feeling sample; and creating knitting control information for knitting the knitted product by the knitting machine according to the specified finished state and the paper pattern data, thereby to knit the fabric according to the knitting control information created.

The invention also provides a knitting apparatus using a stretch yarn for knitting a fabric with a stretch yarn by a knitting machine, comprising:

data storage means for predetermining and storing data specifying relationships between a feed length of the stretch yam to be used for knitting fed to the knitting machine and a yarn length in a finished state of a knitted fabric obtained by shape memory properties of the stretch yarn, by changing gradually tensions of the stretch yam;

specification input means for inputting a specification of the finished state of the knitted fabric; and control means for creating control data for forming a knitted fabric with reference to the data stored in the data storage means, while feeding the stretch yarn in the feed length and under the yarn tension corresponding to the finished state of the knitted fabric, so that the knitted fabric is brought into the finished state inputted to the specification input means.

Moreover, the invention is characterized in that:

the data to be stored in the data storage means contains gauge feeling data indicating a knitting needle array density necessary for a case in which a fabric having a feeling on a stitch loop length equivalent to that of the finished state of the knitted fabric is to be knitted with a knitting yarn other than the stretch yarn; and the specification input means can also specify the finished state with the gauge feeling data.

Moreover, the invention is characterized in that:

the data storage means is prepared with data specifying the relationships on the stretch yarn and the knitting texture for predetermined references; and the data storage means contains not only that data but also data on correction coefficients to the data which are used in a case where other stretch yarns and knitting structures are used and which are concerned with a standard stretch yarn and a standard knitting texture.

BRIEF DESCRIPTION OF DRAWINGS

Other and further objects, features, and advantages of the invention will be more explicit from the following detailed description taken with reference to the drawings wherein:

FIG. 2 is a diagram showing one example of table data 30 to be stored in a memory 21 of FIG. 1.

BEST MODE FOR CARRYING OUT THE INVENTION

Figure 1:
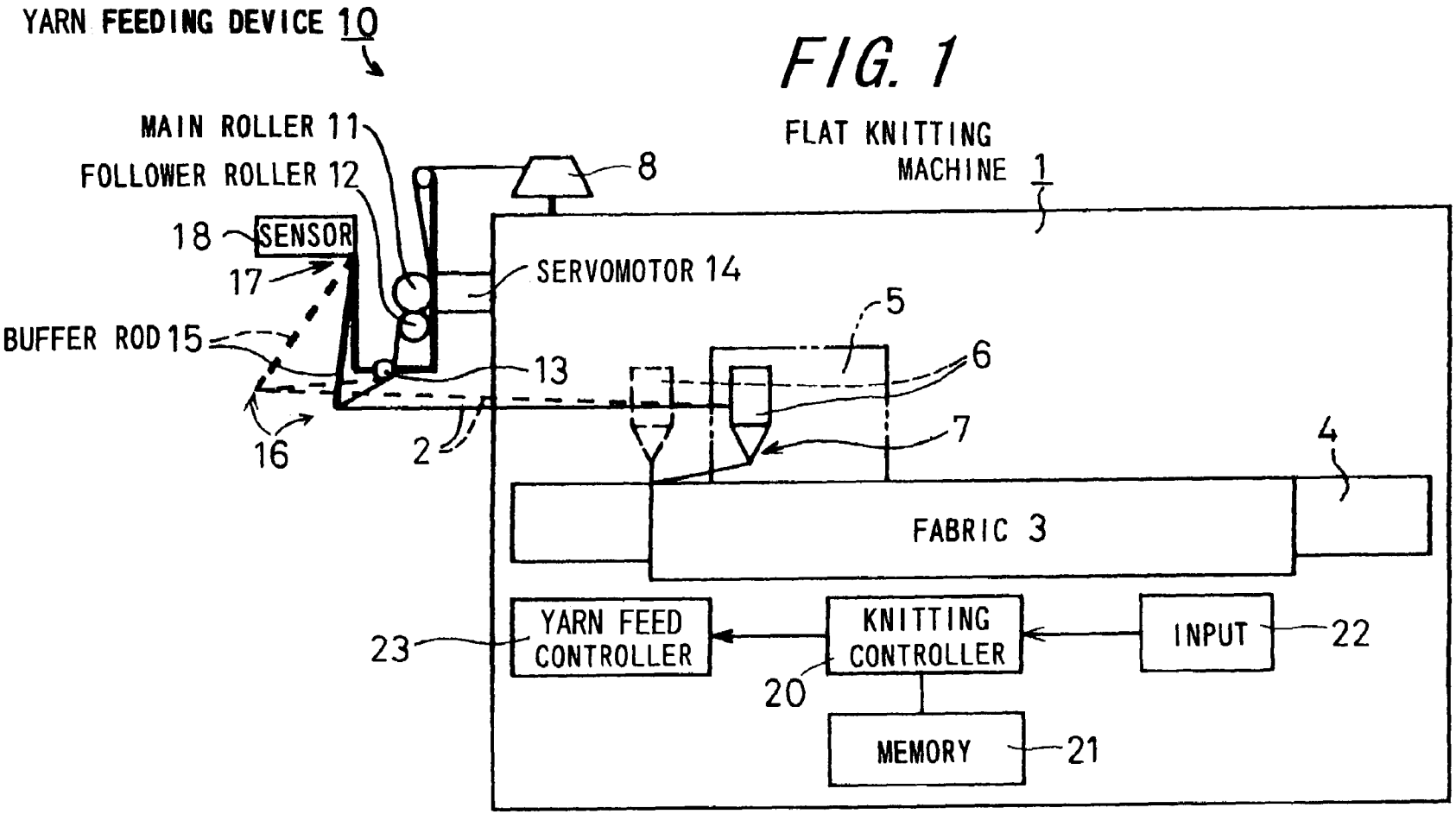
FIG. 1 is a block diagram showing a schematic construction of a flat knitting machine 1 as a knitting machine using a stretch yarn according to an embodiment of the invention.

Now referring to the drawings, preferred embodiments of the invention are described below.

FIG. 1 shows a schematic structure of a flat knitting machine 1 as a knitting apparatus using a stretch yarn according to an embodiment of the invention. The flat knitting machine 1 can knit a fabric 3 with a stretch yarn 2 as a knitting yarn. The flat knitting machine 1 is provided with a needle bed 4, in which a number of knitting needles are arrayed at a predetermined pitch, and a carriage 5 reciprocates along a longitudinal direction of the needle bed 4 thereby to knit the fabric 3. The array pitch of the knitting needles is indicated as an array density of the number per predetermined length by a gauge (G) or the number per 25.4 mm (or 1 inch).

When the carrier 5 moves along the longitudinal direction of the needle bed 4, the carrier 5 can be accompanied with a yarn feeding member 6 called as the "yarn carrier". On the carriage 5, a needle selecting mechanism for selecting the needle to be arranged at the needle bed 4, and a cam mechanism for causing the selected knitting needle to perform the knitting action, are mounted. The yarn feeding member 6 can feed the knitting needle which is selected for the knitting action, at a proper timing with the knitting yarn from a yarn feeding port 7. The flat knitting machine 1 is generally provided with a plurality of yarn feeding members 6, which can be selected for use from the carriage 5. In this embodiment, at least one yarn feeding member 6 is used for the stretch yarn 2. Another yarn feeding member 6 can also be used for an ordinary knitting yarn other than the stretch yarn 2.

The stretch yarn 2 is fed from a cone 8 through a yarn feeding device 10 to the yarn feeding member 6. The yarn feeding device 10 includes a main roller 11, a follower roller 12, a relay roller 13, a servomotor 14 and a buffer rod 15. The stretch yarn 2 drawn from the cone 8 passes through the intermediate roller 13 while being nipped between the main roller 11 and the follower roller 12. The main roller 11 is rotated by the servomotor 14 so that the roller can feed out the stretch yarn 2 of a length necessary for knitting the fabric 3. The stretch yarn 2 having passed through the intermediate roller 13 is turned at a distal end 16 of the buffer rod 15 toward the yarn feeding member 6.

The buffer rod 15 can be swung around its proximal end 17 at a portion thereof from the proximal end 17 to the distal end 16 and is spring-biased so that the distal end 16 gets away from the yarn feeding member 6. Therefore, an inclination angle of the buffer rod 15 due to the swing displacement corresponds to a tension applied to the stretch yarn 2. The proximal end 17 of the buffer rod 15 is provided with a sensor 18 for detecting the inclination angle of the buffer rod 15. Here, the structure thus far described for feeding the stretch yarn 2 and for detecting the tension can also be likewise used for a knitting yarn other than the stretch yarn 2. Moreover, the yarn feeding device 10 thus far described is substantially equivalent to that detailed as the "yarn feeding device 16" in the Applicant's earlier patent application No. 2002-215590. Before knitting a course of the fabric 3, the consumption of yarn necessary for the course knitting is predetermined so that the stretch yarn 2 is positively fed in synchronism with a knitting action of the knitting needle by the carriage 5.

A knitting controller 20 is provided for controlling the actions to knit the fabric 3 by the flat knitting machine 1. The knitting controller 20 controls the carriage 5 and so on in accordance with knitting data and control data stored in a memory. The feeling of the fabric 3 knitted with the stretch yarn 2 fluctuates according to the stitch loop length obtained after knitted. In the case of the fabric 3 using the stretch yarn 2, the stretch yarn 2 shrinks, so that the feeling of the knitted fabric 3 corresponds to that of the knit which is obtained with a needle bed having a higher array density of needles and a larger gauge number than those of the actual gauge of the needle bed 4. In the flat knitting machine 1, the desired feeling can be specified as the stitch loop length and the gauge feeling by inputting them from an input unit 22. In a memory 21, data representing the relationships between the gauge feeling obtained after the knitting and the stitch loop length and the relationships between the length and tension of the stretch yarn 2 fed at the knitting time are collected in advance and stored in the form of table data. The knitting controller 20 make reference to the table data stored in the memory 21, and sets the control targets of the length and tension of the stretch yarn 2 to be fed, for a yarn feed controller 23 so as to acquire the gauge feeling and the stitch loop length specified by the input unit 22.

Specifically, the flat knitting machine 1 of this embodiment is the apparatus for knitting the fabric with the stretch yarn 2 having a stretchability while controlling the yarn tension. The flat knitting machine 1 comprises the memory 21 acting as data storage means for determining and storing the data representing the relationships between the feed length of the stretch yarn 2 used for the knitting to the knitting machine and the stitch loop length in the knitted fabric, for each of different yarn tensions; the input unit 22 acting as specification input means for inputting the specifications of the stitch loop length in the knitted fabric 3; and the knitting controller 20 acting as control means for making controls to knit the fabric 3 while feeding the stretch yarn 2 in the feed length and the yarn tension corresponding to the knitting loop in the knitted fabric 3 with reference to the data stored in the memory 21 so as to acquire the stitch loop length inputted to the input unit 22.

In the following description, the unit of the yarn tension is expressed by "g", which is a weight gram so that the unit can naturally be converted into the Newton (N) unit at the ratio of 1 g=0.0098N. Moreover, the numerical values of the yarn tension and length are represented just for examples and will vary according to the characteristics of the knitting yarn to be used.

FIG. 2 shows an example of table data 30 to be stored in the memory 21 of FIG. 1 while simplifying a portion for conveniences of the description. The table data 30 is prepared for the stretch yarn 2 on the basis of the result that the data is collected, for example, on a stretch yarn A expected to be frequently used. The most basis plain knitting is adopted as a "knitting texture" 31. Data is collected for a "tension" 32 on data of different values. A "loop length (or an initial loop length)" 33 indicates the loop length of the state in which the knitting loop is formed by the knitting needle, and is so set herein that all the density value of the knitting cam of the carriage 5 may be 10 mm. A "stitch number" 34 is the number of stitches used in the knitting of the fabric. A "course length at the knitting time" 35 is the product of the "loop length (or the initial loop length)" 33 and the "stitch number" 34. A "course length (mm) in no-load state" 36 is the course length at which the "knitting course length" 35 varies when the "tension" 32 is 0 g. A "ratio (at the feeding time) to the course length at 0 g" 37 is the ratio of the "course length (mm) in no-load state" 36 to the "course length at the knitting time" 35.

A "course length in the fabric" 38 is the course length in the state of the knitted fabric 3. When the knitting is made under tension with the stretch yarn 2, the fabric 3 is knitted with the stretch yarn 2 being stretched. After the fabric 3 left the knitting needle, the tension is lost so that the stretch yarn 2 will shrink with the tension of 0 g to the original length. The stretch yarn 2 is diametrically reduced when the yarn stretches, but is enlarged when the yarn restores its original length. When the fabric 3 is formed, the stitches are reduced by the shrinkage of the stretch yarn 2 so that the stretch yarn 2 is restricted in its diametrical increase. As a result, the stretch yarn 2 in the knitted fabric 3 does not restore its original length completely but has a residual tension. The data of the "course length in the fabric" 38 is longer than the "course length (mm) in no-load state" 36. Thus, in the state where the tension is left in the fabric 3, the fabric 3 is tensed to have such shape memory properties as restores its original in case an external force disappears, although the fabric has been deformed by the external force. Especially in case the fabric 3 is three-dimensionally formed into a cylindrical shape or a knitted product without being stitched, no stitching restriction is exerted to exhibit the shape memory properties sufficiently.

A "loop length (mm) in the fabric" 39 is given a value by dividing the data of the "course length in the fabric" 38 by the "stitch number" 34. In the case of using the ordinary knitting yarn, the "loop length (mm) in the fabric" 39 determines the feeling of the knitted fabric 3 so that the length is used at the fabric designing time. In case the stretch yarn 2 is used, it is necessary to specify the yarn tension, too. A "ratio to the initial loop length" 40 is a ratio of the "loop length (mm) in the fabric" 39 to the "loop length (or the initial loop length)" 33. An "equivalent gauge" 41 indicates the gauge of the flat knitting machine 1 employed, i.e., "7G" in the example of FIG. 2, when the "tension" 32 is 0 g, and indicates the gauge equivalent to the magnitude of the stitch of the fabric obtained, as "the feeling of - - - G" when the "tension" 32 is not 0 g. This "equivalent gauge" 41 indicates that the stitch is equivalent to that which has been obtained by knitting the knitting yarn other than the stretch yarn 2 by the knitting machine having a larger gauge number indicating the array density of the knitting needles than that actually employed in the knitting operation. By storing the gauge feeling as the data, it is possible to specify the feeling of the desired fabric easily with the gauge feeling. It is also understood that the "loop length (or the initial loop length)" 33 may be calculated by 10/0.75=13.3 mm so that the "ratio to the initial loop length" 40 may be utilized to set the "loop length (mm) in the fabric" 39 at 10.0 mm for the "tension" of 30 g, for example.

However, the table data 30 need not necessarily collect all the data. What is needed is either the course length or the loop length. The "stitch number" 34 is not needed for the data of the loop length. What is needed is any of the "knitting course length" 35, the "course length (mm) in no-load state" 36 and the "ratio (at the feeding time) to the course length at 0 g" 37. In the yarn feeding device 10 of FIG. 1, the length of the stretch yarn 2 to be fed from the main roller 11 and the follower roller 12 is equivalent to the "course length (mm) in no-load state" 36. What is needed is any of "course length (mm) in the fabric" 38, the "loop length (mm) in the fabric" 39 and the "ratio to the initial loop length" 40. Of these, the "loop length (mm) in the fabric" 39 is sufficient. The "equivalent gauge" 41 is substantially the data equivalent to the "loop length (mm) in the fabric" 39.

Of the table data 30, the relation between the "tension" 32 and the "course length (mm) in no-load state" 36 relates the stretchability of the stretch yarn 2 to be used. This is the relation of the elongation to the load and can be measured by means of a tension tester. The "course length (mm) in the fabric" 38 relates not only to the stretchability of the stretch yarn 2 but also to the shapes of the initial stitches corresponding to the initial thickness of the stretch yarn 2 or the "loop length (or the initial loop length)" 33, and has to be actually measured by knitting the fabric 3 actually. The fabric 3 thus knitted for collecting the data can also be utilized as the feeling sample.

Figure 3:
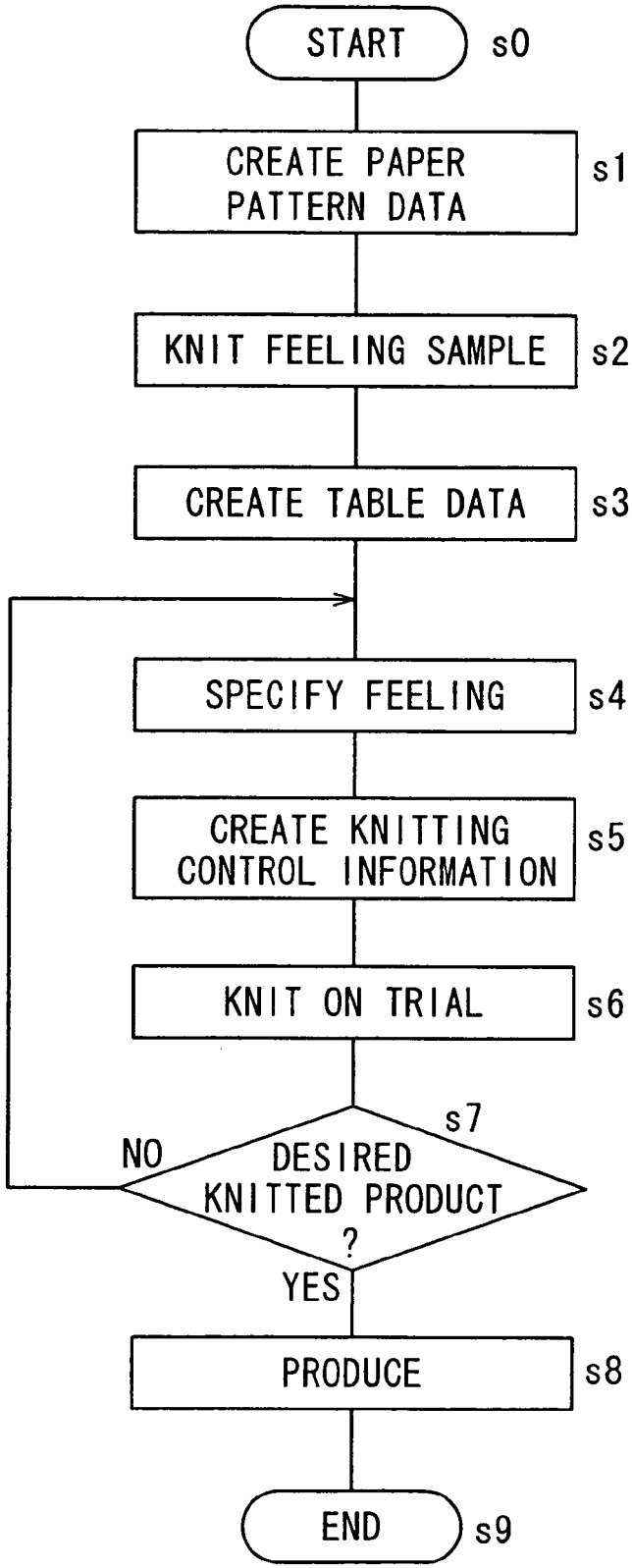
FIG. 3 is a flow chart showing a schematic procedure for manufacturing a knitted product having a desired feeling by employing the flat knitting machine 1 of FIG. 1.

FIG. 3 shows a schematic procedure for manufacturing a knitted product having a desired feeling by employing the flat knitting machine 1 of FIG. 1. The procedure is started from Step s0, and paper pattern data corresponding to the shape of the knitted product is created at Step s1 by employing a CAD (Computer Aided Design) system developed for designing the knitted product. At Step s2, the stretch yarn 2 is used to knit samples of various feelings while changing the knitting conditions such as the "tension" 32 or the "course length (mm) in no-load state" 36. These feeling samples are disclosed in the aforementioned JP-B2 2676182, for example. At Step s3, the table data 30 is created together with the feeling samples.

At next Step s4, the feeling is specified on the basis of the feeling samples. This feeling specifications are performed such that the data stored as the "loop length (mm) in the fabric" 39 or the "equivalent gauge" 41 is displayed in the display screen of the input unit 22 so that the data may be selected by the operator of the flat knitting machine 1. It is also made possible to select intermediate ones of the numerical values stored as the data. In case these intermediate numerical values are specified, the data of the "tension" 32 or the "course length (mm) in no-load state" may be calculated by interpolations.

At next Step s5, the knitting data is created for knitting the fabric 3. In case the desired feeling is specified at Step s4, the "loop length (mm) in the fabric" 39 for the desired feeling, i.e., the stitch loop length in the knitted fabric 3 is designated according to the table data 30 of FIG. 2. Since the stitch loop length of the knitted fabric 3 is specified, the knitting control information such as the vertical row number or the course number for knitting the knitted product by the flat knitting machine 1 can be created according to the paper pattern data for the knitted product prepared at Step s1, so that the fabric 3 can be knitted.

At Step s6, the flat knitting machine 1 is activated to knit the fabric 3 on trial in accordance with the knitting control information. At Step s7, it is decided whether or not the knitted product obtained by the trial knitting has the desired feeling. In case the desired feeling is not obtained, the procedure returns to Step s4. In case it is decided at Steps7 that the desired feeling is obtained, the knitted product is produced at Step s8, and the procedure is ended at Step s9.

In case the fabric 3 is actually knitted, there is used a knitting texture which is different from a plain knitting assumed by the "knitting texture" 31. For the clothing such as sweater, a knitting texture such as a rib stitch is frequently used with the plain knitting. The stretch yarn 2 other than the stretch yarn A may also be used. Moreover, the stretch yarn 2 is used as a core yarn such as the aforementioned covered yarn and is wound therearound with natural fibers such as wool or cotton or chemical fibers such as polyester or nylon. Moreover, the individual stitches to be knitted of the stretch yarn are made different into knit, tuck and miss stitches. Serious burdens are exerted on the preparations of the table data 30, as shown in FIG. 2, according to those differences. For the stretch yarn A in frequent uses, the table data 30, as shown in FIG. 2, creates the plain knitting for all knitting stitches as data of the "knitting texture" 31, and uses such correction coefficients for the other conditions as are tabulated in Table 1. These correction coefficients are prepared for correcting the length of the stretch yarn 2 to be fed as the "course length (mm) in no-load state" 36 from the yarn feeding device 10, when the conditions change from the table data 30.

TABLE 1

| Items | Correction Coefficients | | | |
|---|---|---|---|---|
| Stretch Yarn | Yarn A | Yarn B | Yarn C | |
| Knitting Texture | Plain Knitting | Rib Stitch | | |
| Knitting Yarn | Wool | Cotton | Polyester | Nylon |
| Stretch Yarn Texture | Knit | Tuck | Miss | |

The correction coefficients of Table 1 are stored in the memory 21 of FIG. 1 and are employed to create the knitting data at Step s5 of FIG. 3. In the aforementioned memory 21, specifically, there are prepared as the data storage means not only the table data 30 expressing the aforementioned relationships on the stretch yarn 2 and the knitting texture as a predetermined standard but also the correction coefficient data which are used for the table data 30 on the standard stretch yarn and the standard knitting texture in a case where other stretch yarns and knitting textures are employed. Even if the kind of the stretch yarn 2 or the knitting texture is changed, the fabric 3 of the desired feeling can be knitted on the basis of those relationships in the table data 30 which is corrected with the correction coefficients and obtained on the stretch yarn 2 and the knitting texture for the references.

In the description thus far made, although the invention is realized by the flat knitting machine 1, a computer such as a fabric designing CAD system may be provided with a data creating function for controlling the tension or the yarn feed thereby to transfer the data as the control data to the flat knitting machine.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described hereinbefore, according to the invention, the finished state for the desired feeling of the knitted fabric is specified. Then, the data of the feed length to the knitting machine and the yarn tension is obtained on the stretch yarn used in the knitting, on the basis of the predetermined relationships. When the knitting is performed according to the yarn tension and feed length obtained, the knitted product having a finished state such as the desired feeling can be easily obtained.

Moreover, according to the invention, the desired fabric can be obtained by specifying the knitting loop length of the knitted fabric and the yarn tension at the knitting time.

Moreover, according to the invention, the desired feeling is specified on the basis of the result of the actual comparison of the prepared feeling sample. Then, the finished state for a prepared feeling sample is specified. Since the finished state of the knitted fabric is specified, the knitting control information such as the vertical row number or the course number for knitting the product by the knitting machine can be created to knit the fabric in accordance with the prepared paper pattern data of the knitted product.

Moreover, according to the invention, the finishing state for the desired feeling in the knitted fabric is inputted to the specifying input means. On the basis of the relationships of the data stored in advance in the storage means, the control means acquires the control data of the feed length to the knitting machine and the yarn tension on the stretch yarn to be used for the knitting, so that the knitting machine can be controlled for the knitting operation according to the yarn tension and the feed length obtained. Thus, the knitted product having the finished state such as the desired feeling can be easily obtained.

Moreover, according to the invention, the knitting operation is performed by tensing the stretch yarn. When the stretch yarn is removed after the knitting operation from the knitting needle, the stretch yarn shrinks so that the stitch becomes smaller than the interval between the knitting needle employed. As a result, the fabric is identical to that which is obtained by knitting a knitting yarn other than the stretch one with a knitting machine having a larger numerical value of the gauge number indicating the array density of the knitting needles than that of the knitting machine employed in the actual knitting operation. By storing the gauge feeling as the data, therefore, the desired finishing state can be understandably specified with the gauge feeling.

Moreover, according to the invention, the stretch yarn and the knitting texture are corrected with the correction coefficients, even when the kind of the former and the latter are changed. Then, the fabric of the desired finished state can be knitted on the basis of the relationships which are obtained on the stretch yarn and the knitting texture for the predetermined references.

The invention claimed is:

1. A knitting method using a stretch yarn for knitting a fabric with a stretch yarn by a knitting machine capable of controlling yarn tension, comprising:

predetermining data specifying relationships between a feed length of the stretch yarn to be used for knitting fed to the knitting machine and a yarn length in a finished state of a knitted fabric obtained by shape memory properties of the stretch yarn, by changing gradually yarn tension of the stretch yarn;

specifying the finished state of the knitted fabric; and forming a fabric while feeding the stretch yarn to the knitting machine according to the specified finished state, the yarn tension being related to the data and the feed length of the stretch yarn, wherein the specified finished state of the knitted fabric is based on a feeling sample to be knitted.

2. The knitting method of claim 1, wherein the finished state is specified by the stitch loop length of the knitted fabric and the yarn tension.

3. The knitting method of claim 1, further comprising:

preparing paper pattern data expressing a shape of a knitted product to be formed of the fabric using the stretch yarn and the feeling sample to be knitted by using said stretch yarn, and varying the yarn tension and the stitch loop length of the fabric being knitted; and creating knitting control information for knitting the knitted product with the knitting machine according to the specified finished state and the paper pattern data, to form the knitted fabric according to the created knitting control information.

4. A knitting apparatus using a stretch yarn for knitting a fabric with a stretch yarn by a knitting machine, comprising:

a data storage device to store data specifying relationships between a feed length of the stretch yarn to be used for knitting fed to the knitting machine and a yarn length in a finished state of a knitted fabric obtained by shape memory properties of the stretch yarn, by changing gradually yarn tension of the stretch yarn;

a specification input device to input a specification of the finished state of the knitted fabric; and a control device to create control data for forming a knitted fabric with reference to the data stored in the data storage device, while feeding the stretch yarn in the feed length and under the yarn tension corresponding to the finished state of the knitted fabric, so that the knitted fabric is brought into the finished state inputted to the specification input device, wherein the specification of the finished state of the knitted fabric is based on a feeling sample to be knitted.

5. The knitting apparatus of claim 4, wherein the data to be stored In the data storage device contains gauge feeling data to indicate a knitting needle array density necessary when a fabric having a feeling on a stitch loop length equivalent to that of the finished state of the knitted fabric is to be knitted with a knitting yarn other than the stretch yarn, and the specification input device can also specify the finished state with the gauge feeling data.

6. The knitting apparatus of claim 4, wherein the data storage device is prepared with data specifying the relationships on the stretch yarn and the knitting texture for predetermined references; and the data storage device contains not only that data but also data on correction coefficients of the data which are used when other stretch yarns and knitting structures are used, and which are concerned with a standard stretch yarn and a standard knitting texture.

7. The knitting method of claim 2, further comprising:

preparing paper pattern data expressing a shape of a knitted product to be formed of the fabric using the stretch yarn and the feeling sample to be knitted by using said stretch yarn, and varying the yarn tension and the stitch loop length of the fabric being knitted; and creating knitting control information for knitting the knitted product with the knitting machine according to the specified finished state and the paper pattern data, to form the knitted fabric according to the created knitting control information.

8. The knitting apparatus of claim 5, wherein the data storage device is prepared with data specifying the relationships on the stretch yarn and the knitting texture for predetermined references; and the data storage device contains not only that data but also data on correction coefficients of the data which are used when other stretch yarns and knitting structures are used, and which are concerned with a standard stretch yarn and a standard knitting texture.

* * * * *